US007452234B2

(12) United States Patent
Ma

(10) Patent No.: US 7,452,234 B2
(45) Date of Patent: Nov. 18, 2008

(54) SOCKET CONNECTOR WITH MATCHABLE PADDING

(75) Inventor: Wen-Qiang Ma, ShenZhen (CN)

(73) Assignee: Hon Hai Precision Ind. Co. Ltd., Taipei Hsien (TW)

( * ) Notice: Subject to any disclaimer, the term of this patent is extended or adjusted under 35 U.S.C. 154(b) by 0 days.

(21) Appl. No.: 11/825,265

(22) Filed: Jul. 5, 2007

(65) Prior Publication Data

US 2008/0007933 A1 Jan. 10, 2008

(51) Int. Cl.
*H01R 13/648* (2006.01)

(52) U.S. Cl. ..... 439/382; 439/607

(58) Field of Classification Search ..... 439/382, 439/607, 384, 608–610
See application file for complete search history.

(56) References Cited

U.S. PATENT DOCUMENTS 4,451,103 A * 5/1984 Buresh et al. ..... 439/382
6,128,194 A * 10/2000 Francis ..... 361/737
6,320,756 B1 * 11/2001 Ikeda ..... 361/760
6,672,882 B2 * 1/2004 Chien ..... 439/71
7,229,290 B1 * 6/2007 Chang et al. ..... 439/62
7,333,328 B2 * 2/2008 Funawatari et al. ..... 361/685
2004/0141253 A1 * 7/2004 Funawatari et al. ..... 360/97.01

* cited by examiner

*Primary Examiner*—Gary F. Paumen
(74) *Attorney, Agent, or Firm*—Wei Te Chung

(57) ABSTRACT

A socket connector includes a bottom shielding (10) with a receiving room (15), an electronic module (2) received in the receiving room of the bottom shielding, an elastic padding (20) defined between the electronic module and the bottom shielding, and a top shielding (30) for engaging with the bottom shielding and pressing the electronic module tightly in the bottom shielding. Wherein, the electronic module has an un-coplanar lower surface, and the thickness of different parts of the padding varies for supporting different parts of the un-coplanar bottom surface of the electronic modular. Therefore, the electronic module can be fitly mounted in the receiving room of the bottom surface when the top shielding engaging with the bottom shielding and pressing onto the electronic module.

13 Claims, 2 Drawing Sheets

SOCKET CONNECTOR WITH MATCHABLE PADDING

BACKGROUND OF THE INVENTION

1. Field of the Invention

The present invention generally relates to the field of electrical connectors. And more particularly, one embodiment of the invention relates to a socket connector adapted for receiving an electronic module therein.

2. General Background

Socket connectors are widely used in various electrical devices. Basically, the socket connector comprises a bottom shielding with receiving room, an electronic module received in the receiving room of the bottom shielding, and a top shielding for engaging with the bottom shielding and pressing the electronic module tightly in the bottom shielding.

However, the bottom surface of the electronic module, which is attached to the bottom shielding, is usually defined un-coplanar for the purpose of arranging connecting elements. Therefore, the electronic module can not be fitly mounted in the bottom surface of the receiving room, even if the top shielding engaging with the bottom shielding and pressing onto the module.

Therefore, an improved socket connector is desired to overcome the aforementioned deficiencies and inadequacies.

SUMMARY

According to an embodiment of the present invention, a socket connector comprises a bottom shielding with a receiving room, an electronic module received in the receiving room of the bottom shielding, an elastic padding defined between the electronic module and the bottom shielding, and a top shielding for engaging with the bottom shielding and pressing the electronic module tightly in the bottom shielding. Wherein, the electronic module has an un-planar lower surface, and the thickness of different parts of the padding varies for supporting different parts of the un-coplanar bottom surface of the electronic modular. Therefore, the electronic module combined with the padding can be fitly mounted in the receiving room of the bottom surface when the top shielding engaging with the bottom shielding and pressing onto the electronic module.

The present invention is illustrated by way of example and not limitation in the figures of the appended drawings, in which like references indicate identical elements, and in which:

DETAILED DESCRIPTION OF THE EMBODIMENT

Figure 1:
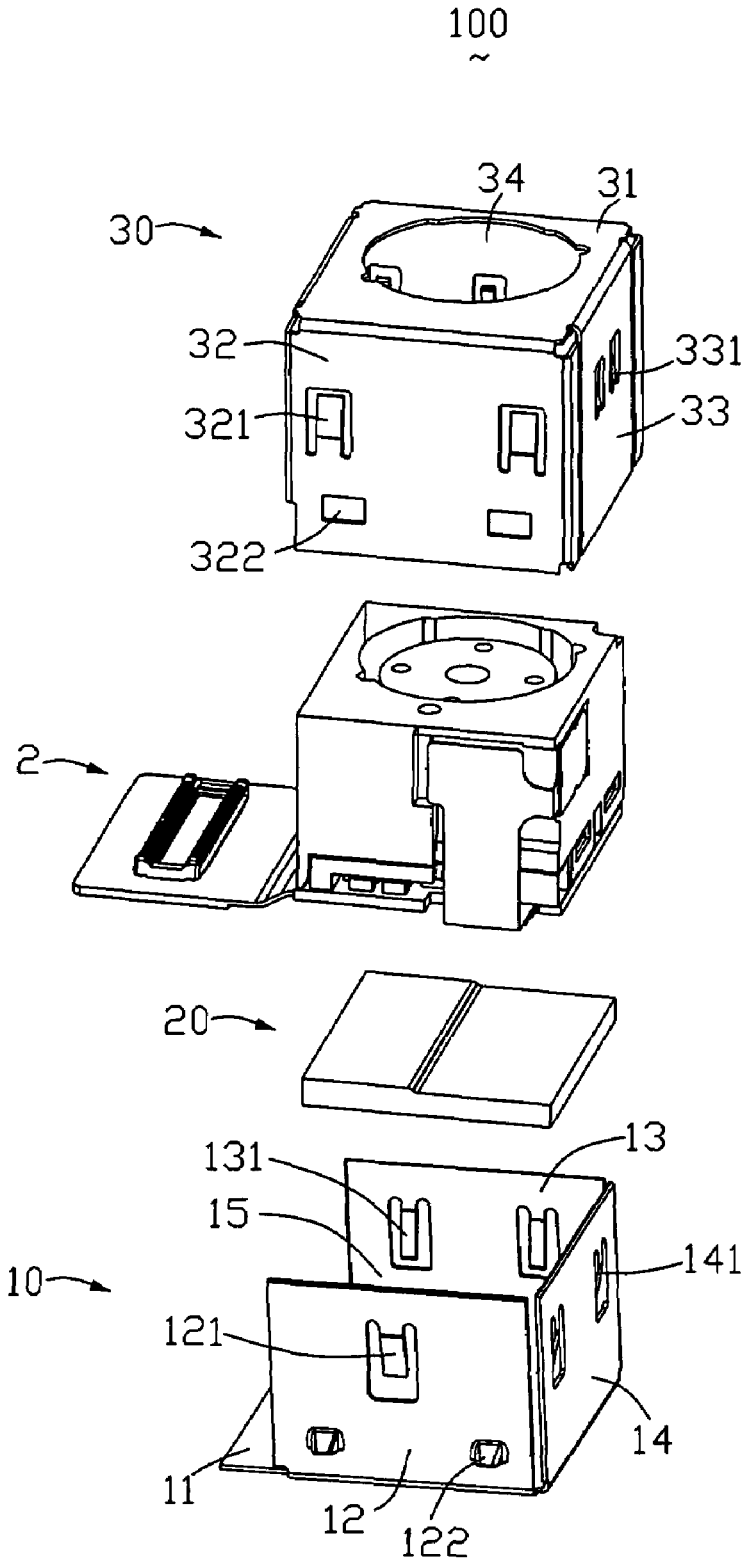
FIG. 1 is an exemplary isometric, exploded view of a socket connector in accordance with an embodiment of the present invention.

In the following detailed description, for purposes of explanation, numerous specific details are set forth in order to provide a thorough understanding of the embodiment of the present invention. It will be apparent, however, that the present invention may be practiced without these specific details. In other instances, well-known structures and devices are schematically shown in order to simplify the drawing.

Figure 2:
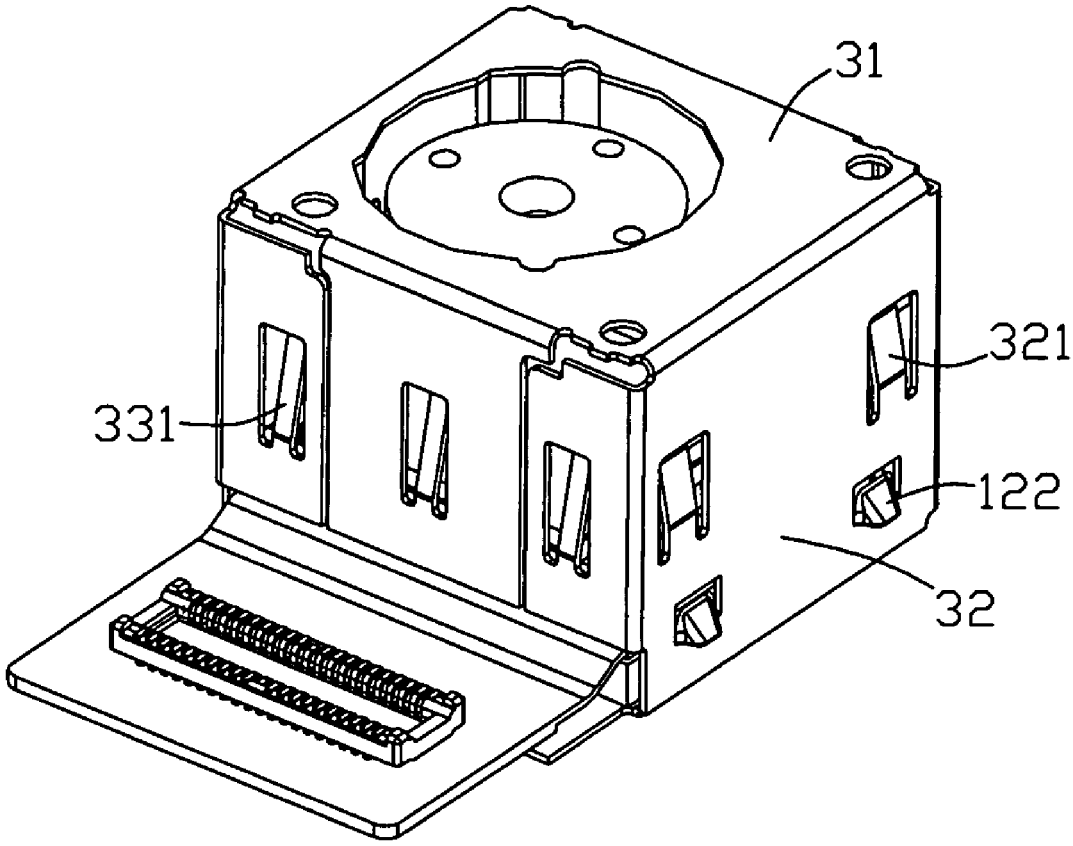
FIG. 2 is an exemplary isometric, assembled view of a socket connector as shown in FIG. 1.

Referring to FIG. 1 and FIG. 2, the socket connector 100 includes a metal bottom shielding 10 having a receiving room 15, an electronic module 2 received in the receiving room 15, an elastic padding 20 defined between the electronic module 2 and the bottom shielding 10, and a top shielding 30 for engaging with the bottom shielding 10 and pressing the electronic module 2 tightly in the bottom shielding 10. Wherein, the electronic module has an un-coplanar lower surface.

The bottom shielding includes a bottom surface 11, a front wall 12, a back wall 13 and a side wall 14 extending upwardly from three adjacent sides of the bottom surface 11 respectively. A receiving room 15 is formed among said bottom surface 11, front wall 12, back wall 13 and side wall 14. The electronic module 2 is secured in the receiving room 15. The front wall 12 defines an engaging portion 121 extending into the receiving room 15 for securing the electronic module 2, and a pair of protruding tabs 122 protruding outward for engaging with the top shielding 30. The back wall 13 and the side wall 14 each defines a pair of engaging portions 131, 141 extending into the receiving room 15.

The elastic padding 20 defines a substantially rectangular configuration, corresponding to the bottom surface 11 of the bottom shielding 10. The elastic padding 20 is defined between the bottom shielding 10 and the electronic module 2. A lower surface of the padding 20 attaches onto the bottom surface 11 of the bottom shielding 10, and a top surface of the padding 20 supports the electronic module 2. The top surface of the padding 20 is defined un-coplanar, corresponding to the lower surface of the electronic module 2. That is, the padding 20 has different thicknesses in different parts thereof for supporting different parts of the un-coplanar lower surface of the electronic modular 2. Therefore, the electronic module 2 can be fitly assembled in the receiving room 15.

The top shielding 30 is defined to engage with the bottom shielding 10 and press the electronic module 2 tightly in the bottom shielding 10. The top shielding 30 includes a top surface 31, a pair of first side walls 32 extending downwardly from a pair of opposite sides of the top surface 31, and a pair of second side walls 33 extending form another pair of opposite sides of the top surface 31. The top surface 31, the first side walls 32 and the second side walls 33 cooperatively form an accommodating room 34. The first side walls 32 and the second side walls 33 each defines a pair of elastic tabs 321, 331 extending into the accommodating room 34 for engaging with the bottom shielding 10. The first side walls 32 further defines a pair of slots 322 corresponding to the protruding tabs 122 of the bottom shielding 10 for locking the top shielding 30 onto the bottom shielding 10.

In assembly, the elastic padding 20 is defined in the receiving room of the bottom shielding 10, and a coplanar lower surface of the padding 20 attaches onto the bottom surface 11 of the bottom shielding 10. The electronic module 2 is subsequently assembled onto the top surface of the padding 20. The engaging portions 121, 131, 141 of the bottom shielding 10 engage with the electronic module 2 respectively, therefore the electronic module 2 is secured in the bottom shielding 10. When the top shielding 30 covers the bottom shielding 10 from the top down, the elastic tabs 321, 331 of the top shielding 30 engage with corresponding sides of the bottom shielding 10, and the slots 322 engage with corresponding protruding tabs 122. Therefore, the top shielding 30 is locked with the bottom shielding 10, and the electronic module 2 is pressed in the bottom shielding 10. Because the top surface of the padding 20 is defined un-coplanar for compensating the un-coplanar lower surface of the electronic module 2, the electronic module 2 can be fitly assembled in the receiving room. When the top shielding 30 presses the electronic module 2, the electronic module 2 can be tightly and fitly sandwiched between the top shielding 30 and the padding 20.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A socket connector comprising:

a bottom shielding having a receiving room;

an electronic module received in the receiving room of the bottom shielding;

an elastic padding defined between the electronic module and the bottom shielding; and a top shielding for engaging with the bottom shielding and pressing the electronic module tightly in the bottom shielding;

wherein, the electronic module defines an un-coplanar lower surface, the thickness of different parts of the padding varies corresponding to the lower surface of the electronic module for supporting different parts of the un-coplanar lower surface of the electronic module.

2. The socket connector according to claim 1, wherein the bottom shielding comprises a bottom surface, a front wall, a back wall and a side wall extending upwardly from three adjacent sides of the bottom surface respectively.

3. The socket connector according to claim 2, wherein the top shielding comprises a top surface, a pair of first side walls extending from a pair of opposite sides of the top surface, and a pair of second side walls extending form another pair of opposite sides of the top surface.

4. The socket connector according to claim 3, wherein a pair of protruding tabs is defined in the front wall of the bottom shielding, and a pair of slots is defined in the first side wall of the top shielding corresponding to the protruding tabs for locking with the protruding tabs.

5. The socket connector according to claim 4, wherein the front wall of the bottom shielding defines an engaging portion extending into the receiving room for securing the electronic module.

6. The socket connector according to claim 5, wherein the first side walls and the second side walls of the top shielding each defines a pair of elastic tabs for engaging with the bottom shielding.

7. A socket connector comprising:

a bottom shielding having a receiving room;

an electronic module received in the receiving room of the bottom shielding;

an elastic padding defined between the electronic module and the bottom shielding; and a top shielding for engaging with the bottom shielding and pressing the electronic module tightly in the bottom shielding;

wherein, the electronic module defines an un-coplanar lower surface, the elastic padding defines an un-coplanar surface for compensating the un-coplanar lower surface of the electronic module.

8. The socket connector according to claim 7, wherein the bottom shielding comprises a bottom surface, a front wall, a back wall and a side wall extending upwardly from three adjacent sides of the bottom surface respectively.

9. The socket connector according to claim 8, wherein the top shielding comprises a top surface, a pair of first side walls extending from a pair of opposite sides of the top surface, and a pair of second side walls extending form another pair of opposite sides of the top surface.

10. The socket connector according to claim 9, wherein a pair of protruding tabs is defined in the front wall of the bottom shielding, and a pair of slots is defined in the first side wall of the top shielding corresponding to the protruding tabs for locking with the protruding tabs.

11. The socket connector according to claim 10, wherein the front wall of the bottom shielding defines an engaging portion extending into the receiving room for securing the electronic module.

12. The socket connector according to claim 11, wherein the first side walls and the second side walls of the top shielding each defines a pair of elastic tabs for engaging with the bottom shielding.

13. A socket connector assembly comprising:

a metallic shell defining a receiving cavity;

an electronic module received in the receiving cavity;

a first uneven roughly two-level structure formed on an underside of the electronic module; and a second uneven roughly at least two-level structures formed on a pad complementary to the first uneven roughly at least two-level structure; wherein said pad is sandwiched between the underside of the electronic module and a bottom plate of the shell.

* * * * *